US012228380B2

(12) United States Patent
Taylor et al.

(10) Patent No.: US 12,228,380 B2
(45) Date of Patent: Feb. 18, 2025

(54) MINE CLEARANCE

(71) Applicant: PEARSON ENGINEERING LIMITED, Newcastle upon Tyne (GB)

(72) Inventors: Jonathan Taylor, Newcastle upon Tyne (GB); Richard Cronk, Newcastle upon Tyne (GB); Simon Gilroy, Newcastle upon Tyne (GB)

(73) Assignee: PEARSON ENGINEERING LIMITED, Newcastle upon Tyne (GB)

( * ) Notice: Subject to any disclaimer, the term of this patent is extended or adjusted under 35 U.S.C. 154(b) by 0 days.

(21) Appl. No.: 18/033,620

(22) PCT Filed: Sep. 27, 2021

(86) PCT No.: PCT/EP2021/076538
§ 371 (c)(1),
(2) Date: Apr. 25, 2023

(87) PCT Pub. No.: WO2022/089857
PCT Pub. Date: May 5, 2022

(65) Prior Publication Data

US 2023/0366659 A1 Nov. 16, 2023

(30) Foreign Application Priority Data

Oct. 27, 2020 (GB) ..... 2017051

(51) Int. Cl.
*F41H 11/24* (2011.01)

(52) U.S. Cl.
CPC ..... *F41H 11/24* (2013.01)

(58) Field of Classification Search
CPC ..... F41H 11/24
USPC ..... 89/1.13
See application file for complete search history.

(56) References Cited

U.S. PATENT DOCUMENTS 4,967,850 A * 11/1990 Bargfrede ..... F41H 11/24 172/197
5,046,565 A * 9/1991 Purcell ..... E02F 3/7609 172/830
2012/0186421 A1* 7/2012 Firth ..... F41H 11/30 89/1.13
2013/0014633 A1* 1/2013 Diaz ..... F41H 5/06 89/937
2015/0362295 A1* 12/2015 Bradley ..... F41H 11/30 89/1.13

FOREIGN PATENT DOCUMENTS

EP 0071384 A2 2/1983
EP 0467023 A1 1/1992
EP 0588047 A1 3/1994
EP 0718588 A1 6/1996
GB 2545638 A 6/2017

OTHER PUBLICATIONS

Dec. 9, 2021—(WO) International Search Report and Written Opinion—Appl. No. PCT/EP2021/076538.
Apr. 15, 2021—(GB) Search Report—Appln. No. 2017051.0.

* cited by examiner

*Primary Examiner* — Samir Abdosh
(74) *Attorney, Agent, or Firm* — Banner & Witcoff, Ltd.

(57) ABSTRACT

A deployable mine clearance device is provided and comprises one or more blade members that are movable from a stowed position to a deployed position.

17 Claims, 9 Drawing Sheets

MINE CLEARANCE

CROSS-REFERENCE TO RELATED APPLICATIONS

Figure 1:
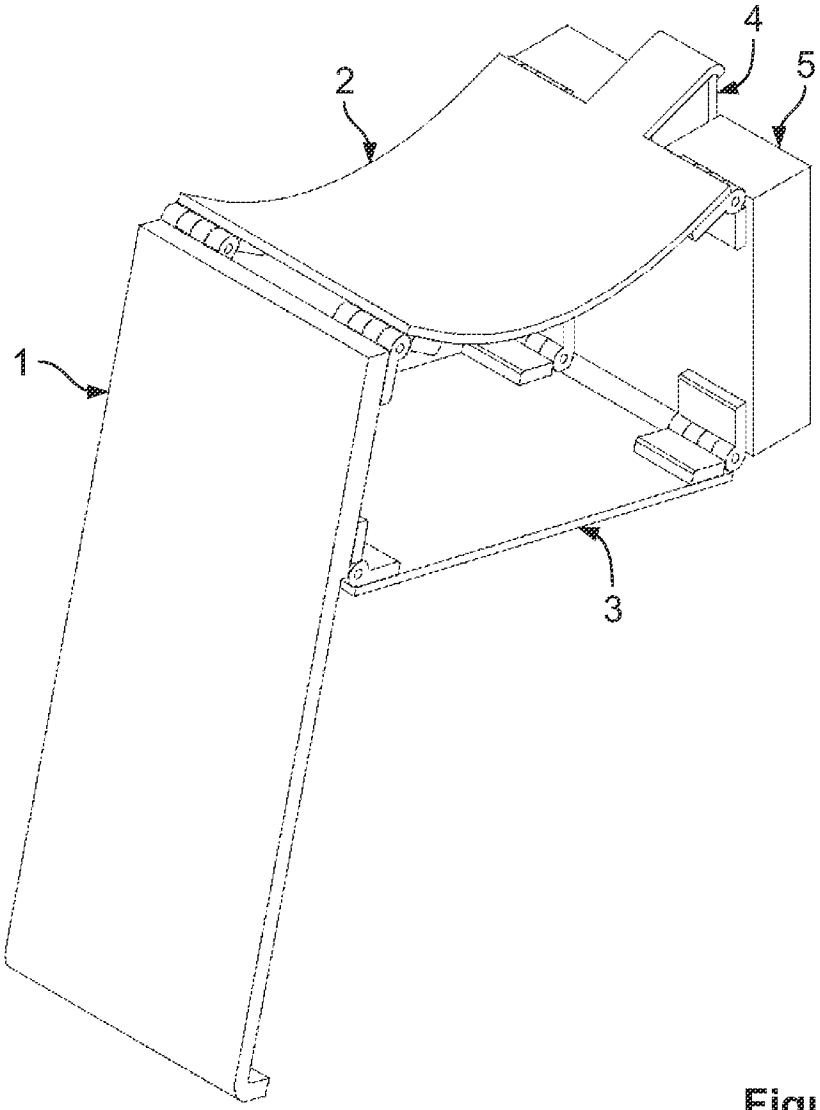

This application is a U.S. National Stage application under 35 U.S.C. § 371 of International Application PCT/EP2021/076538 (published as WO 2022/089857A1), filed on Sep. 27, 2021 which claims the benefit of priority to GB 2017051.0, filed on Oct. 27, 2020. Each of these prior applications is hereby incorporated by reference in its entirety.

The present invention relates generally to mine clearance and particularly, although not exclusively, to the clearance of surface laid or scattered mines, for example through the application of a lightweight and compact system.

Known surface clearance devices are bulky and heavy pieces of equipment which, when fitted, reduce the capability of the host vehicle.

The present invention seeks to provide improvements in or relating to mine clearance.

Some aspects and embodiments relate to or provide a scatterable mine clearance device.

An aspect of the present invention provides a deployable mine clearance device comprising one or more blade members that are movable from a stowed position to a deployed position.

A further aspect provides a mine clearance tool comprising one or more members that are movable from a stowed position to a deployed position.

In some embodiments the device is formed to provide a lightweight, folding clearance mechanism.

Some aspects and embodiments allow for a mine clearance device to be fitted to nearly any vehicle, with minimal impact.

In some embodiments the device could be worn as a "life-jacket" to protect against attack of scatterable mines and/or carried as a "lifeboat" to escape from a mined area, without the need for heavy engineering vehicles to accompany. The solution could, for example, be applied to front-line combat vehicles and/or to logistics vehicles.

The or each member may include a latch for locking the member in a deployed position.

The or each member may be biased to the deployed position. A restraining mechanism (such as a cover) may be provided to hold the device in the stowed position. When it is required the device can be released and members automatically move to the deployed position.

The or each member may comprise a front plate, a top link, and a bottom link. The member may also comprise a chassis (which could, for example, be a chassis common to a plurality of members).

In some embodiments the front plate has a stiffness to improve the tendency to collect and remove mines. A "tuned stiffness" aspect of blade front plate may be helpful to the action of the blade.

The bottom link may act as a break-back, to prevent overload and damage. A "break-back bottom link" may be useful to a lightweight realisation of the concept and may tune strength to the application. Without this mechanism additional strength and mass may be required.

The top link may act as a leaf-spring, to apply a push-down force on to the ground in use. A "leaf spring top link" may, for example, allows simple realisation of the mechanism, integrates the auto-deployment and automatic latching in to the working position.

A device may be formed with a plurality of blade members mounted in a row. Each member may comprise a plurality of elements (e.g. a top link, a bottom link and a front plate). The elements may be mounted on a chassis, for example; the chassis may be considered as a blade member element.

One or more of rows of members may be arranged as a row assembly to form a straight or V-shaped clearance blade. The blade may be attachable to a host vehicle by a support structure.

The support structure may allow some movement of the blade assembly relative to the vehicle to enable it to contour the ground.

In some embodiments each element of a member is connected to its neighbour by a hinge, forming a linkage, for example a 4-bar linkage (e.g. with a chassis forming/being an element of member and/or the elements forming a working member mechanism in combination with a chassis).

The cross-sectional area (e.g. defined as depth multiplied by height) of the working member/s in the stowed position, may be 50% or less, 25% or less, or 10% or less than the cross-sectional area in the deployed position. The stowed position volume of the device may, for example, be less than 10% of the deployed position volume.

A further aspect provides a deployable mine clearance blade comprising a plurality of blade members that are movable from a stowed position to a deployed position, the members are biased to deployed position and can be held in the stowed position.

A further aspect provides a deployable mine clearance tool comprising a plurality of members that are movable from a stowed position to a deployed position, the members are biased to deployed position and can be held in the stowed position.

The present invention also provides a vehicle, such as a military vehicle, fitted with one or more devices or tools as described herein.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

Figure 2:
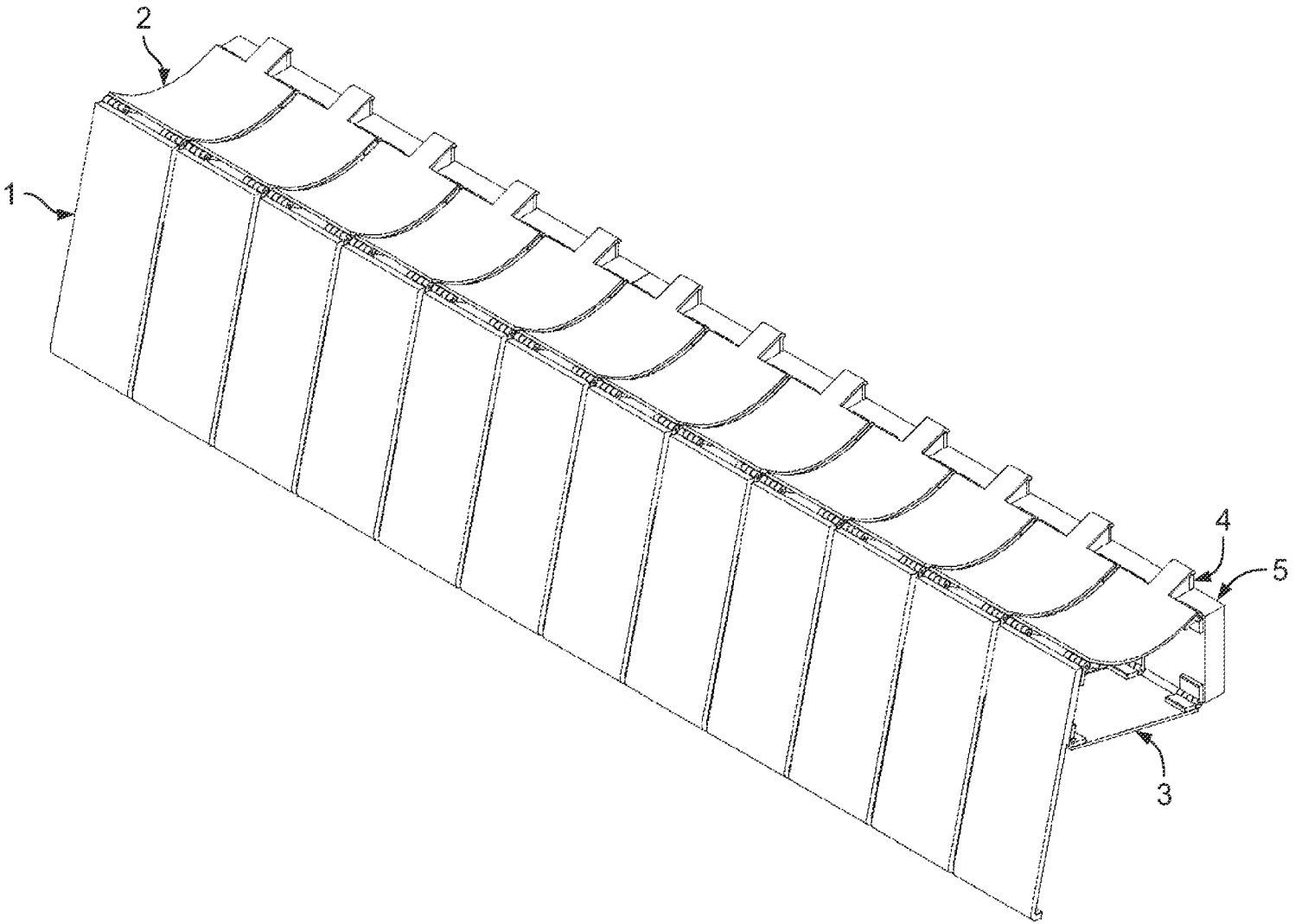
Figure 3:
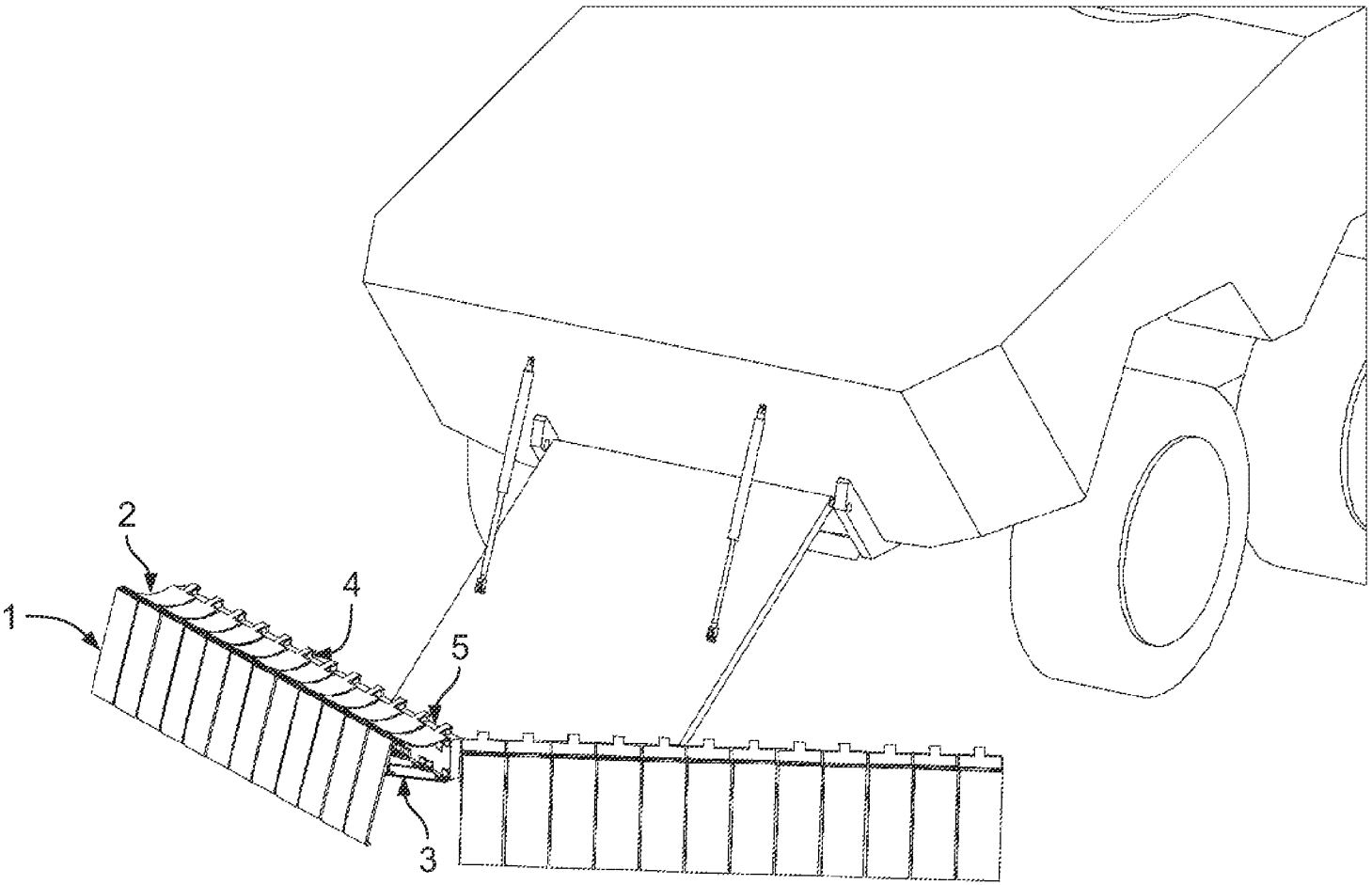
Figure 4C:
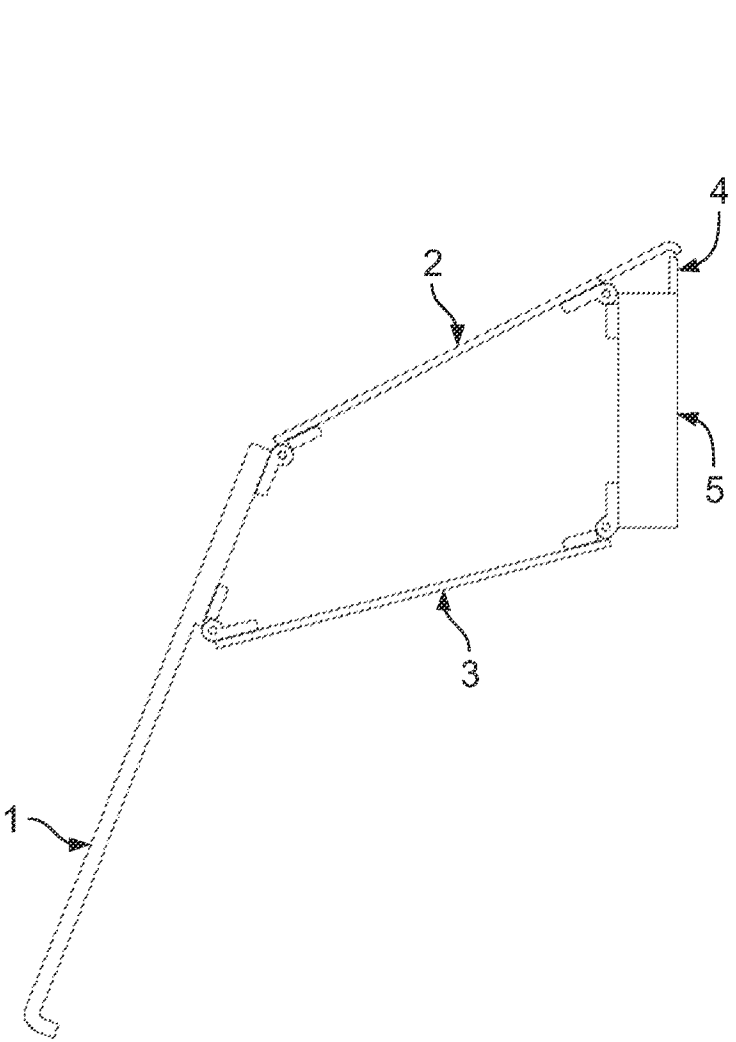
Figure 4B:
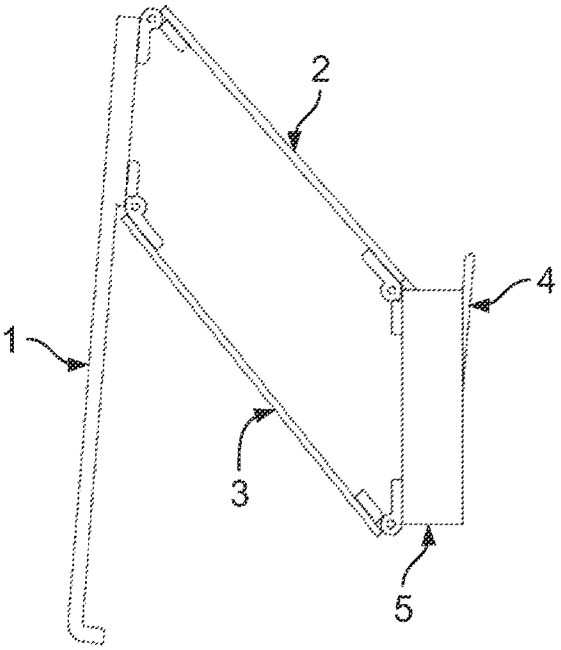
Figure 4A:
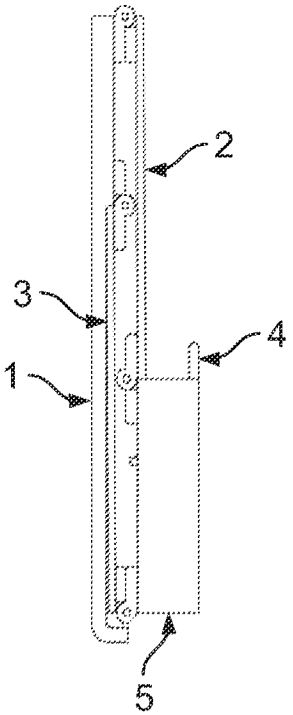
Figure 5B:
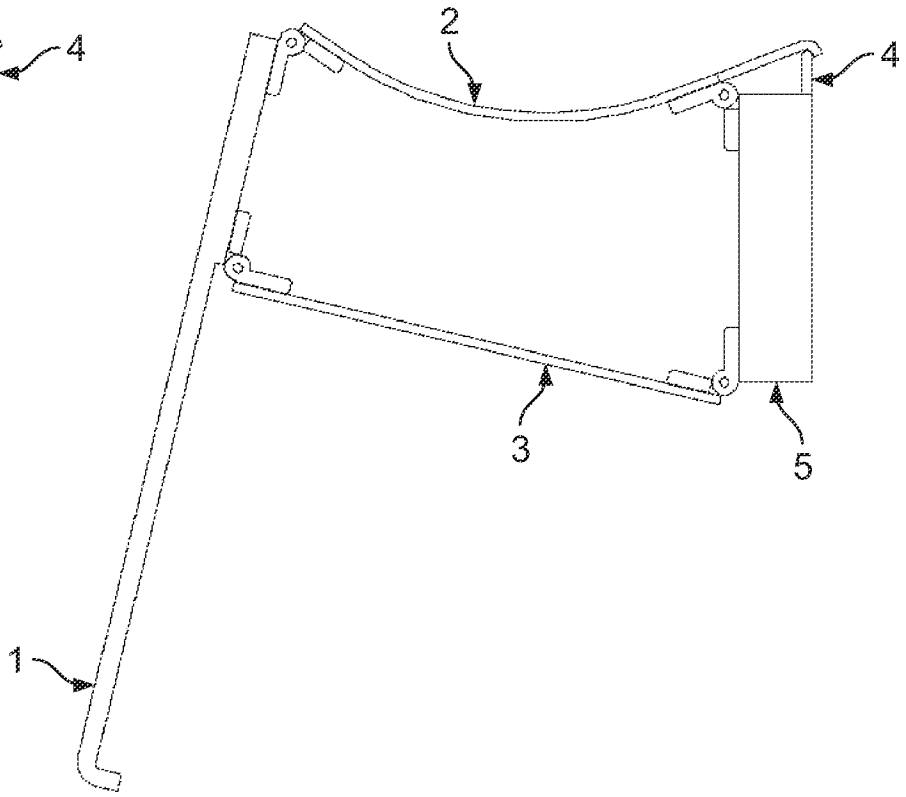
Figure 5A:
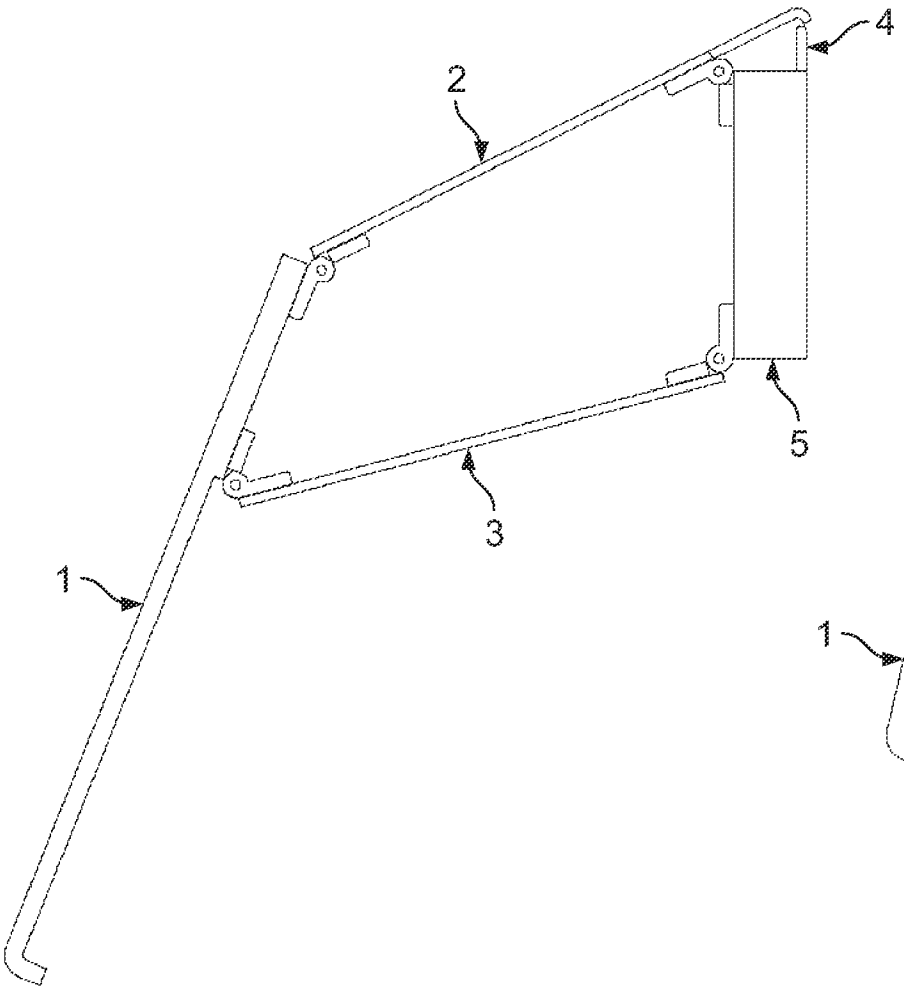
Figure 6B:
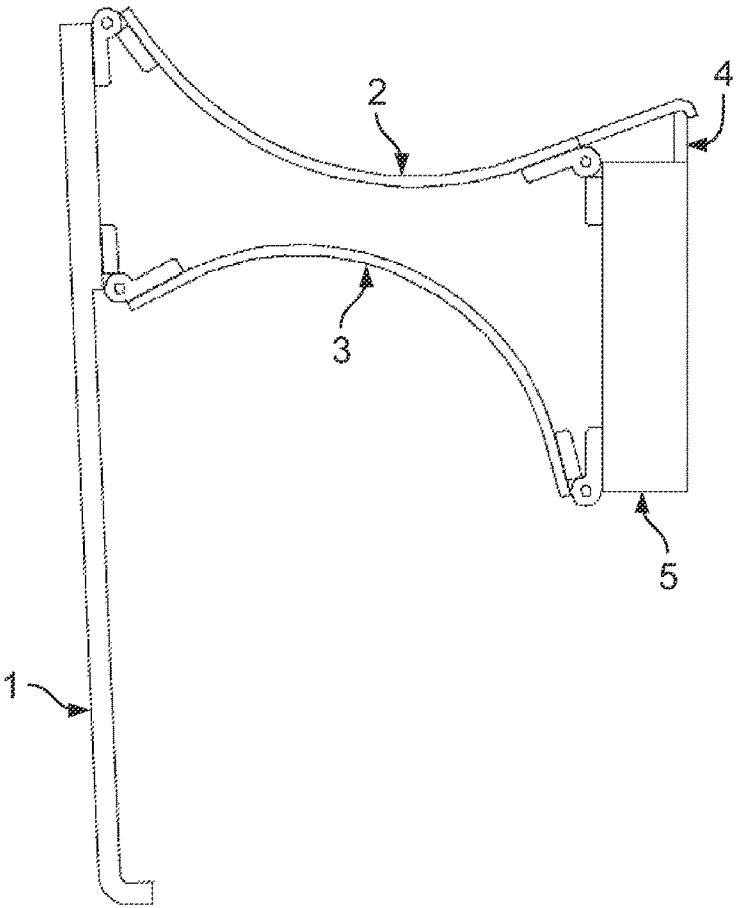
Figure 6A:
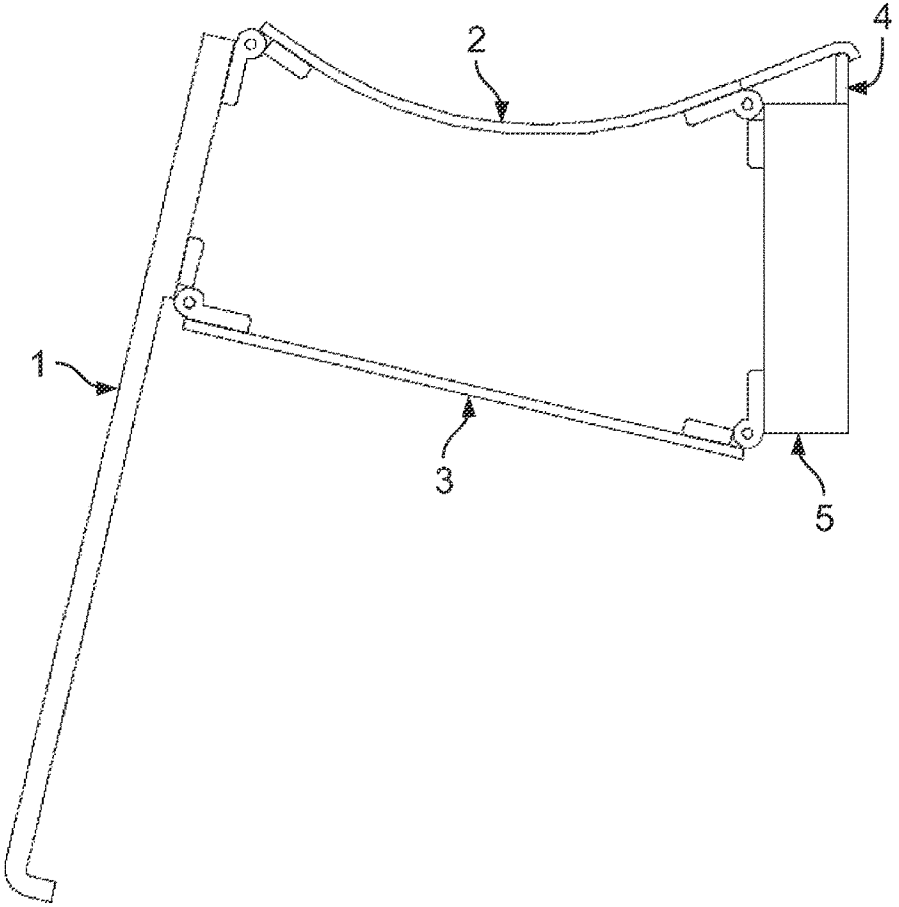
Figure 7A:
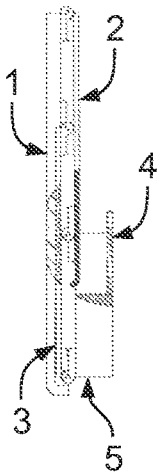
Figure 7B:
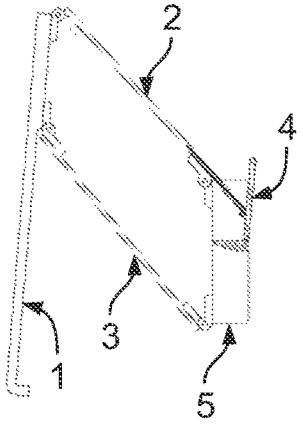
Figure 7C:
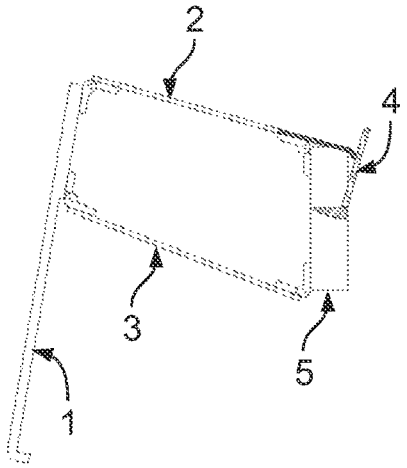
Figure 7D:
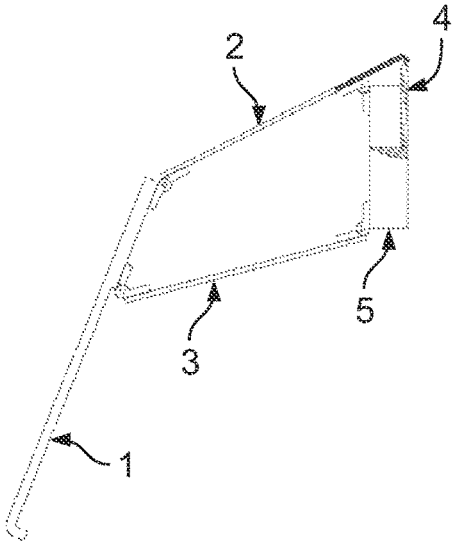
Figure 7E:
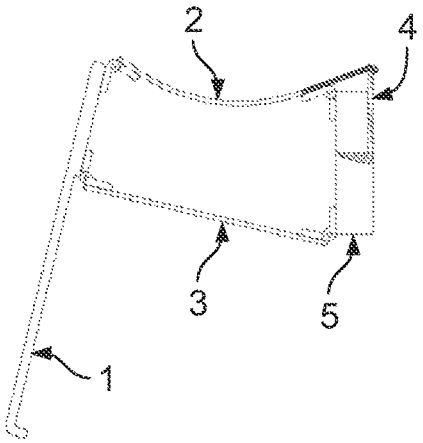
Figure 8A:
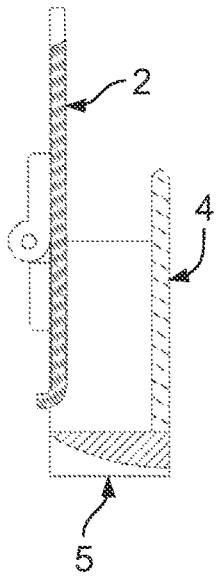
Figure 8B:
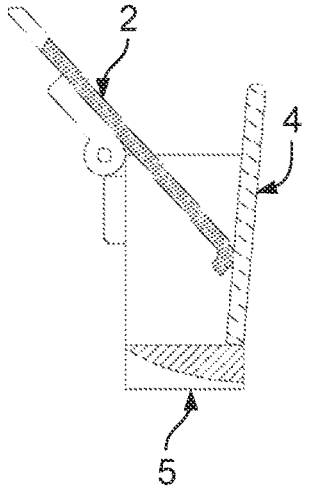
Figure 8C:
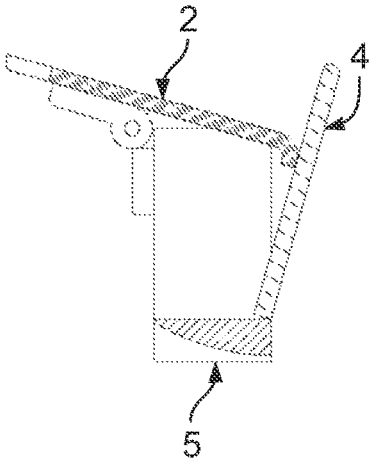
Figure 8D:
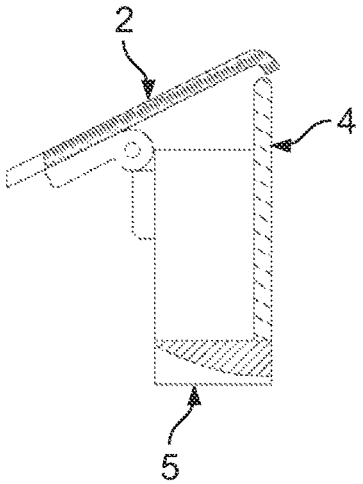
Figure 8E:
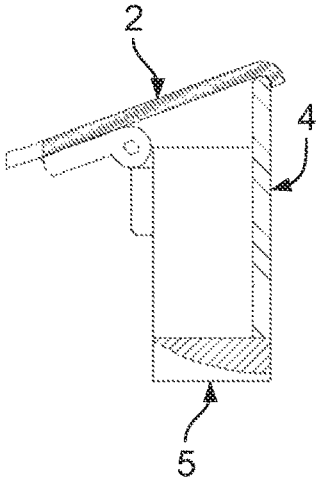
Figure 9B:
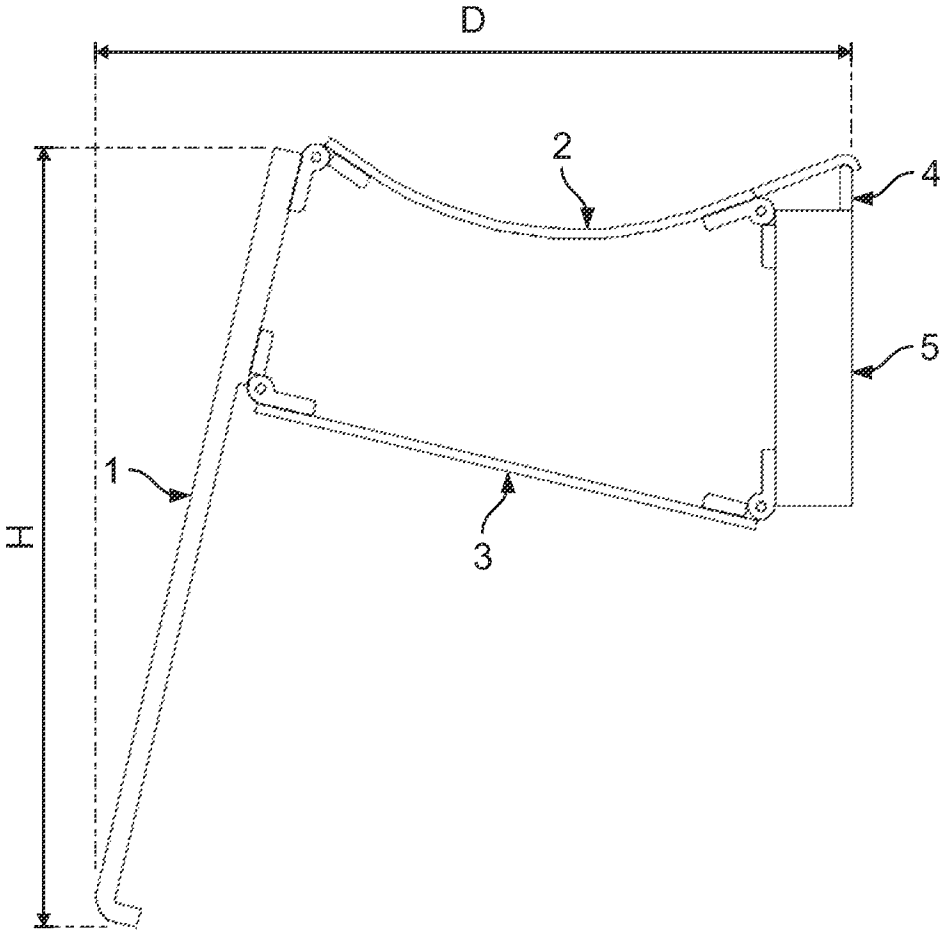
Figure 9A:
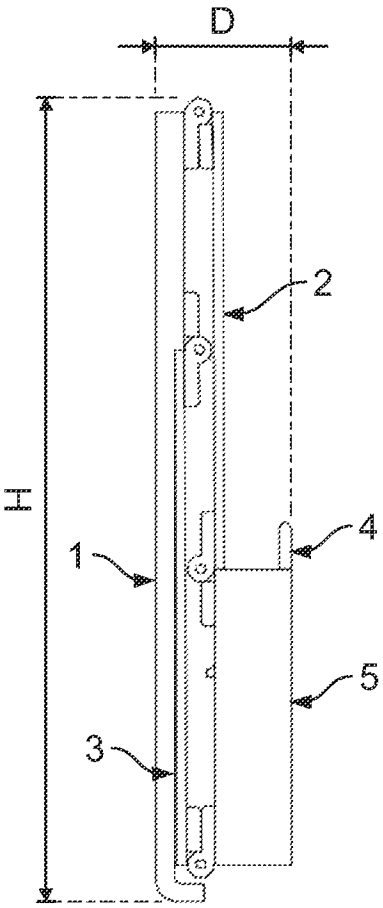

The present invention will now be more particularly described, by way of example, with reference to the accompanying drawings, in which:

FIG. 1—the elements of the working member;

FIG. 2—a single row assembly comprising multiple members each including front plates, top and bottom links, mounted to a common chassis;

FIG. 3—two row assemblies are mounted to a host vehicle by means of a boom and actuators;

FIG. 4—(left) the blade member is folded (right) the member is unfolded and latched in place;

FIGS. 4A-4C—(left) the blade member is folded (right) the member is unfolded and latched in place;

FIG. 5A and FIG. 5B—(left) the blade member is deployed (right) the blade member is preloaded on the ground;

FIG. 6A and FIG. 6B—(left) the blade member is preloaded on the ground (right) the break-back bottom link buckles on overload;

FIGS. 7A-7E—(left to right) the motion of the latch from stowed to fully engaged;

FIGS. 8A-8E—(left to right) detail view showing the motion of the latch from stowed to fully engaged; and FIG. 9A and FIG. 9B—calculating the "area" of the stowed and deployed working member.

Example embodiments are shown and described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate. The invention is not limited in the design and shape of the structure shown in the drawings.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The working component of the clearance device members comprises three elements: the front plate (1), the top link (2), and the bottom link (3). This is also a latch (4) which locks the mechanism. These are mounted in a row, to a chassis (5). In this embodiment the chassis is common to all members in a row; in other embodiments separate chassis plates could be provided for each member. In some embodiments the chassis could also be considered as an element.

Each element of a member is connected to its neighbour by a hinge, creating, together with the chassis, a 4-bar linkage which can fold away into a small package against the chassis or fold out into its working configuration when required. One or more of these row assemblies form a straight or V shaped clearance blade which is attached to a host vehicle by a suitable support structure. This structure is able to move the blade assembly between a stowed and a deployed position and when deployed the support structure allows some movement of the blade assembly relative to the vehicle to enable it to contour the ground.

In this embodiment the linkage is arranged so that the front plate path (locus) is able to contour sharp steps, uneven ground, and changes in ground level.

The linkage is designed for compact packaging, where the stowed package is <10% of the deployed volume.

The linkage will, when released from its stowed position, by release of a cover or other means, fall under gravity to open itself and remain in an operational position. When fully open a latch will be actuated and lock the top link to the chassis.

During opening a latch striker (4) is pushed rearward by a latch hook plate, which is integrated into the top link (3).

When deployed, the latch striker is clear to return to the closed position.

When the mechanism is loaded into the ground, the latch hook engages on the striker and locks the top link in position.

The front plate has a specific stiffness, to improve the tendency to collect and remove mines. If the front plate is too stiff the impact forces are increased, requiring a stronger and heavier structure. If the front plate is too flexible it will tend to sweep over the mines without clearing them.

The bottom link acts as a break-back, to prevent overload and damage to the blade, for example, when a rigid obstacle is encountered. By acting through a buckling mechanism, the bottom link is rigid up until an overload force is reached, whereupon it will deflect.

The top link acts as a leaf-spring, to apply a push-down force on to the ground. This keeps the bottom edge of the front plate in contact with the ground.

The cross-sectional area, defined as depth multiplied by height (D×H as illustrated in FIG. 9) of the working member in the stowed position, is 25% or less than the cross-sectional area in the deployed position. In this embodiment, for example, stowed position is approximately I8% of the area of the deployed position.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A deployable mine clearance device comprising a plurality of working members that are movable from a stowed position to a deployed position, the working members are biased to the deployed position, the working members comprise a front plate, a top link and a bottom link, the working members are mounted to a chassis in a row, the chassis is common to all working members in a row, in which the chassis is attachable to a host vehicle by a support structure, in which the support structure allows some movement of the chassis relative to the vehicle to enable the device to contour the ground, in which each of the plurality of working member is individually movable relative to the chassis, and in which the front plate of each of the plurality of working members is able to contour the ground.

2. A deployable mine clearance device as claimed in claim 1, in which the working members includes a latch for locking the member in a deployed position.

3. A deployable mine clearance device as claimed in claim 1, in which the front plate has a stiffness to improve the tendency to collect and remove mines.

4. A deployable mine clearance device as claimed in claim 1, in which the bottom link acts as a break-back, to prevent overload and damage.

5. A deployable mine clearance device as claimed in claim 1, in which the top link acts as a leaf-spring, to apply a push-down force on to the ground in use.

6. A deployable mine clearance device as claimed in claim 1, in which one or more rows form a straight or V-shaped clearance blade which is attachable to a host vehicle by a support structure.

7. A deployable mine clearance device as claimed in claim 1, in which each working member is configured as a 4-bar linkage.

8. A deployable mine clearance device as claimed in claim 1, in which each element of a working member is connected to its neighbour by a hinge, creating a 4-bar linkage.

9. A deployable mine clearance device as claimed in claim 1, in which the cross-sectional area of the or each working member in the stowed position is 25% or less than the cross-sectional area in the deployed position.

10. A deployable mine clearance device as claimed in claim 1, in which the stowed position volume is less than 10% of the deployed position volume.

11. A vehicle fitted with one or more deployable mine clearance devices as claimed in claim 1.

12. A vehicle as claimed in claim 11, in which one or more rows of working members form a straight or V-shaped clearance blade.

13. A vehicle as claimed in claim 12, in which the one or more rows of working members are attachable to the vehicle by a support structure.

14. A deployable mine clearance device comprising a support structure, a chassis and a plurality of blade members mounted to the chassis in a row and movable from a stowed position to a deployed position, said blade members being biased to the deployed position, said blade members comprising a front plate, a top link and a bottom link, each of them being connected to its neighbour by a hinge, creating, together with the chassis, a 4-bar linkage movable between said stowed position and said deployed position, in which one or more of rows of blade members are arranged as a row assembly to form a straight or V-shaped clearance blade assembly, in that the blade assembly is attachable to a host vehicle by a support structure, and in that the support structure allows some movement of the blade assembly relative to the vehicle to enable it to contour the ground.

15. A deployable mine clearance device as claimed in claim 14, comprising a restraining mechanism to hold the device in the stowed position.

16. A deployable mine clearance device as claimed in claim 15, in which the restraining mechanism is a cover.

17. A deployable mine clearance device as claimed in claim 1, in which in the stowed position the front plate folds flat against the chassis.

* * * * *